US005245844A

United States Patent [19]

Panzer

[11] Patent Number: 5,245,844

[45] Date of Patent: Sep. 21, 1993

[54] PIN TO PENDANT CONVERTER

[76] Inventor: Mitchell E. Panzer, 505 Oak Terrace, Merion, Pa. 19066

[21] Appl. No.: 866,940

[22] Filed: Apr. 10, 1992

[51] Int. Cl.[5] ..... A44C 25/00; A44C 3/00

[52] U.S. Cl. ..... 63/2; 63/1.1; 63/20

[58] Field of Search ..... 62/2, 1.1, 20, 21, 23; 403/389, 391, 393

[56] References Cited

U.S. PATENT DOCUMENTS

| | | | |
|---|---|---|---|
| 992,659 | 5/1911 | Hartoch | 63/1.1 |
| 2,274,269 | 2/1942 | Jellinek | 63/1.1 |
| 2,548,140 | 4/1951 | Bohlinger | 63/1.1 |
| 2,930,209 | 11/1960 | Altman | 63/2 |
| 3,225,565 | 12/1965 | Bohlinger | 63/2 |
| 3,850,010 | 11/1974 | Noto | 63/2 |
| 4,276,757 | 7/1981 | Boening | 63/1.1 |

*Primary Examiner*—Peter M. Cuomo
*Assistant Examiner*—Flemming Saether
*Attorney, Agent, or Firm*—Caesar, Rivise, Bernstein, Cohen & Pokotilow Ltd.

[57] ABSTRACT

A device for converting a pin having a needle shaped hasp and a clamp to a pendant is disclosed. The device comprises an elongated rod with a loop at each end with the loops being aligned axially to permit the loops to be slid over the hasp of a pin. The device further has a loop disposed centrally of the rod for enabling a necklace to be slid therethrough.

1 Claim, 1 Drawing Sheet

PIN TO PENDANT CONVERTER

BACKGROUND OF THE INVENTION

The invention relates generally to jewelry and more particularly to a device for use in enabling a pin to be worn as a pendant of a necklace.

There are many types of pins which are ornamental which are worn by being attached to clothing by a needle shaped hasp on the back of the pin. Often, pins are converted to other forms of ornaments by removing the needle shaped hasp and replacing the securement member on the back of the pin, for the purpose of connecting the ornament in ways other than by passing a needle through clothing. Thus a loop may be connected to the pin for connecting it to a chain so that it can be worn as a necklace/pendant. However, this must be done by a jeweler and it requires a jeweler to remove the loop and attach a needle shaped hasp to the back of the pin so that it can again be worn as a pin.

OBJECTS OF THE INVENTION

It is, therefore, the general object of this invention to provide a pin to pendant converter which overcomes the disadvantages of the prior art.

It is a further object of this invention to provide a pin to pendant converter which enables a pin to be worn as a pendant without changing the configuration of the pin.

It is yet a further object of this invention to provide a pin to pendant converter which easily converts a pin to a pendant by providing sleeve means which slide over the needle shaped hasp and enable a removable loop to be connected to the back of the pin for the purpose of connecting the pin to a necklace so that the pin may be worn as a pendant on the necklace.

SUMMARY OF THE INVENTION

These and other objects of this invention are achieved by providing a device for converting a pin, which has a needle shaped hasp and clamp to a pendant. The device comprises means for being removably connected to the hasp and means for removably connecting the device to a necklace. Thus, when the device of the invention is connected to the hasp and the necklace, the pin acts like a pendant on the necklace. The device includes a pair of loops, which are axially aligned and slidable over the needle shaped hasp, and a loop for removably connecting the device to a necklace.

DESCRIPTION OF THE DRAWING

These and other objects and many of the attendant advantages of this invention will be readily appreciated as the same becomes better understood by reference to the following detailed description when considered in connection with the accompanying drawing wherein.

DETAILED DESCRIPTION OF THE PREFERRED EMBODIMENT

Figure 1:
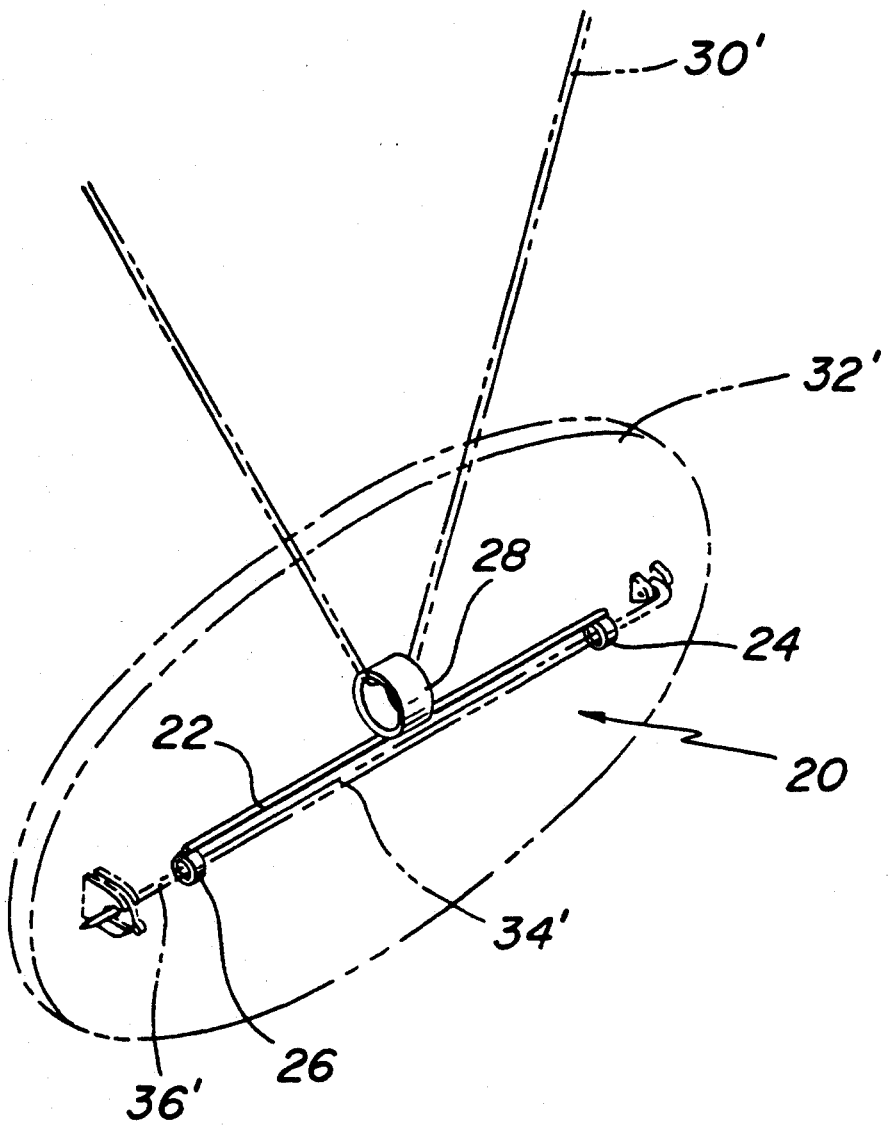
FIG. 1 is a perspective view of a pin to pendant converter embodying the invention and shown mounted on the back of a pin and connected to a necklace, with the necklace and the pin both being shown in phantom.

Referring now in detail to the figure of the drawing, there is shown at 20 in FIG. 1 a pin to pendant converter constructed in accordance with the subject invention.

The pin to pendant converter 20 is a device comprised of a rod 22, which is preferably made of a rigid metal such as stainless steel, brass or the like. Connected to the rod are a pair of loops 24 and 26, which are preferably made of similar material and are secured preferably by soldering or welding to the rod with one at each end.

The device may also be made of other materials such as plastic. The loops 24 and 26 have their openings axially aligned. A third loop 28 having a longitudinal axis substantially parallel to the axis of loops 24 and 26 is provided which is also secured to the rod 22 preferably by welding or soldering. Loops 24 and 26 are secured at the outer periphery of each loop to one side of rod 22, with the loop 28 preferably being on the opposite side and being of a shape which is best configured to receive the chain of a necklace which is shown at 30' in the figure.

The loops 24 and 26 are configured to easily slide over the needle shaped hasp of a pin.

As seen in FIG. 1, a conventionally made pin is shown in phantom at 32'. The pin comprises a pivotable needle shaped hasp 34' and a clamp 36' which releasably holds the pin 34' in place.

When the hasp 34' is removed from clamp 36', the loops 24 and 26 of the converter device can be slid axially over the hasp 34' to the position shown in FIG. 1. When the hasp 34' is disposed in a locked position within the clamp 36', as shown in FIG. 1, the converter device is in position to enable the pin 32' to be converted to a pendant for use with a necklace 30'.

After the pin has been worn as a pendant, and it is desired to wear the pin 32' by attaching it to clothing by use of the hasp 34', it is necessary only to unlock clamp 36', remove the hasp 34' from the clamp and then slide the converter device off of the hasp 34'.

Similarly, to place the pin on a necklace requires only inserting a necklace through the opening in the loop 28 and taking the necklace out of the loop 28 when the pin is no longer worn as a pendant.

Without further elaboration, the foregoing will so fully illustrate my invention that others may, by applying current or future knowledge, readily adapt the same for use under various conditions of service.

I claim:

1. A device for converting a pin having a needle shaped hasp and clasp to a pendant which can be hung from a necklace, said device including an elongated rod with a loop secured at each end to a first side of said rod to be slid over the hasp of said pin for removably connecting said device to said hasp, said device further having a loop disposed centrally of said rod, said centrally disposed loop being permanently secured directly to said rod at a side opposite said first side, and dimensioned to enable said necklace to be slid therethrough for removably connecting said device to said necklace, the opening of said centrally disposed loop including a longitudinal axis which is substantially parallel to a axis which extends through said loops at each end of the said elongated rod, so that when said device is connected to said hasp and said necklace, said pin forms a pendant on said necklace.

* * * * *